US011433292B1

(12) United States Patent
Gay

(10) Patent No.: US 11,433,292 B1
(45) Date of Patent: Sep. 6, 2022

(54) PADDED OVERSHOE ASSEMBLY

(71) Applicant: Douglas Gay, Aloha, OR (US)

(72) Inventor: Douglas Gay, Aloha, OR (US)

( * ) Notice: Subject to any disclaimer, the term of this patent is extended or adjusted under 35 U.S.C. 154(b) by 0 days.

(21) Appl. No.: 17/348,366

(22) Filed: Jun. 15, 2021

(51) Int. Cl.
*A63C 13/00* (2006.01)
*A43B 3/16* (2022.01)

(52) U.S. Cl.
CPC ..... *A63C 13/001* (2013.01); *A43B 3/16* (2013.01); *A63C 13/005* (2013.01)

(58) Field of Classification Search
CPC ..... A63C 13/00; A63C 13/001; A63C 13/003; A63C 13/005; A63C 13/006; A63C 13/02; A43B 3/16; A43B 3/0026; A43B 5/18
USPC ..... 36/122–125
See application file for complete search history.

(56) References Cited

U.S. PATENT DOCUMENTS 2,932,910 A 4/1960 Brown
3,541,623 A 11/1970 Duda
3,726,028 A 4/1973 Stokes
4,258,910 A 3/1981 Carter
4,611,411 A * 9/1986 Ringler ..... A43B 3/0026 36/7.8
5,259,125 A 11/1993 Gromes
D377,710 S 2/1997 Poust
6,035,557 A 3/2000 Mills
2006/0096124 A1* 5/2006 Moseley ..... A43B 3/128 36/11.5
2007/0251127 A1* 11/2007 Gallay ..... A63C 13/02 36/122
2008/0178494 A1* 7/2008 Gallay ..... A63C 13/006 36/125
2009/0265957 A1* 10/2009 Laug ..... A63C 13/005 36/125
2011/0113651 A1* 5/2011 Barchet ..... A63C 13/006 36/125
2016/0144266 A1* 5/2016 Dussault ..... A63C 13/006 36/125
2018/0043235 A1* 2/2018 Laug ..... A63C 13/003

FOREIGN PATENT DOCUMENTS

DE 69814640 T2 * 3/2004
WO WO-2012137203 A2 * 10/2012 ..... A43B 3/0026

* cited by examiner

*Primary Examiner* — Ted Kavanaugh

(57) ABSTRACT

A padded overshoe assembly for facilitating a user to walk on a fragile surface includes a shoe binding for receiving a user's shoe. A paddle is provided and the shoe binding is pivotally disposed on the paddle. The paddle has a width and a length that is greater than the width and the length of the sole to evenly distribute the user's weight over a surface upon which the user is walking thereby reducing the likelihood the user will damage the surface. A cushion is coupled to and extends downwardly from the paddle to abut the surface upon which the user is walking. Additionally, the cushion is comprised of a resiliently compressible material to inhibit the surface from being damaged by the user.

4 Claims, 5 Drawing Sheets

PADDED OVERSHOE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to overshoe devices and more particularly pertains to a new overshoe device for facilitating a user to walk on a fragile surface. The device includes a shoe binding that is pivotally coupled to a paddle for evenly distributing the user's weight. A cushion is coupled to the paddle for cushioning the paddle on a surface upon which the user is walking.

(2) Description of Related Art Including Information Disclosed Under 37 CFR 1.97 and 1.98

The prior art relates to overshoe devices including an overshoe device comprising foam block with shoe straps for walking in snow. The prior art discloses a ski device with shoe bindings to facilitate a user to walk on water. The prior art discloses an overshoe device that includes a sole that is pivotally disposed on a platform and a shoe binding being coupled to the sole for engaging a user's shoe. The prior art discloses a roofer's shoe attachment which comprises a series of straps that engage a user's shoe and a sole coupled to the straps for enhancing traction on a roof. The prior art discloses an overshoe with a pivotal element that can engage a pitched roof to facilitate a user to stand upright on the pitched roof.

BRIEF SUMMARY OF THE INVENTION

An embodiment of the disclosure meets the needs presented above by generally comprising a shoe binding for receiving a user's shoe. A paddle is provided and the shoe binding is pivotally disposed on the paddle. The paddle has a width and a length that is greater than the width and the length of the sole to evenly distribute the user's weight over a surface upon which the user is walking thereby reducing the likelihood the user will damage the surface. A cushion is coupled to and extends downwardly from the paddle to abut the surface upon which the user is walking. Additionally, the cushion is comprised of a resiliently compressible material to inhibit the surface from being damaged by the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
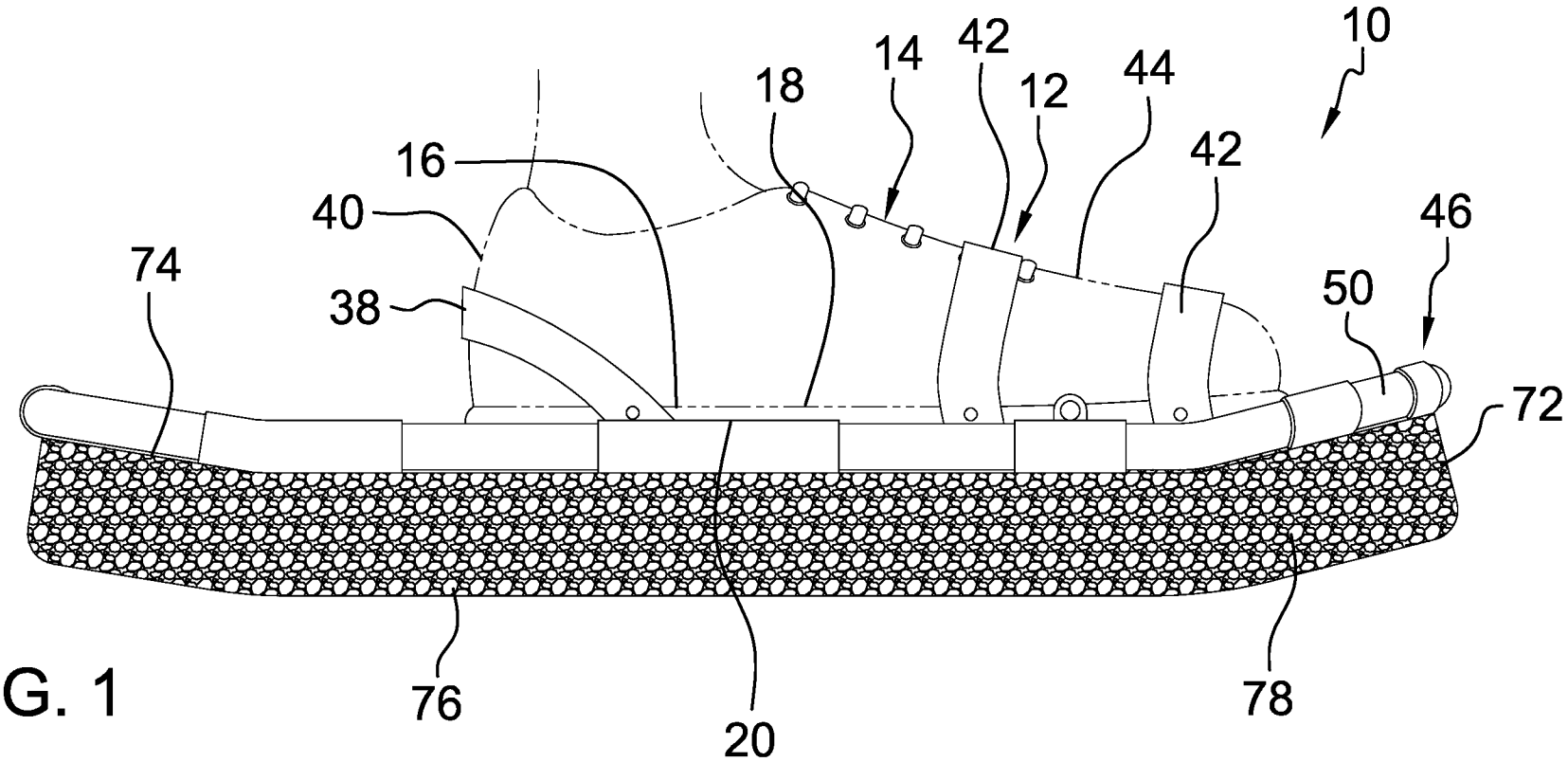
FIG. 1 is a right side in-use view of a padded overshoe assembly according to an embodiment of the disclosure.
Figure 2:
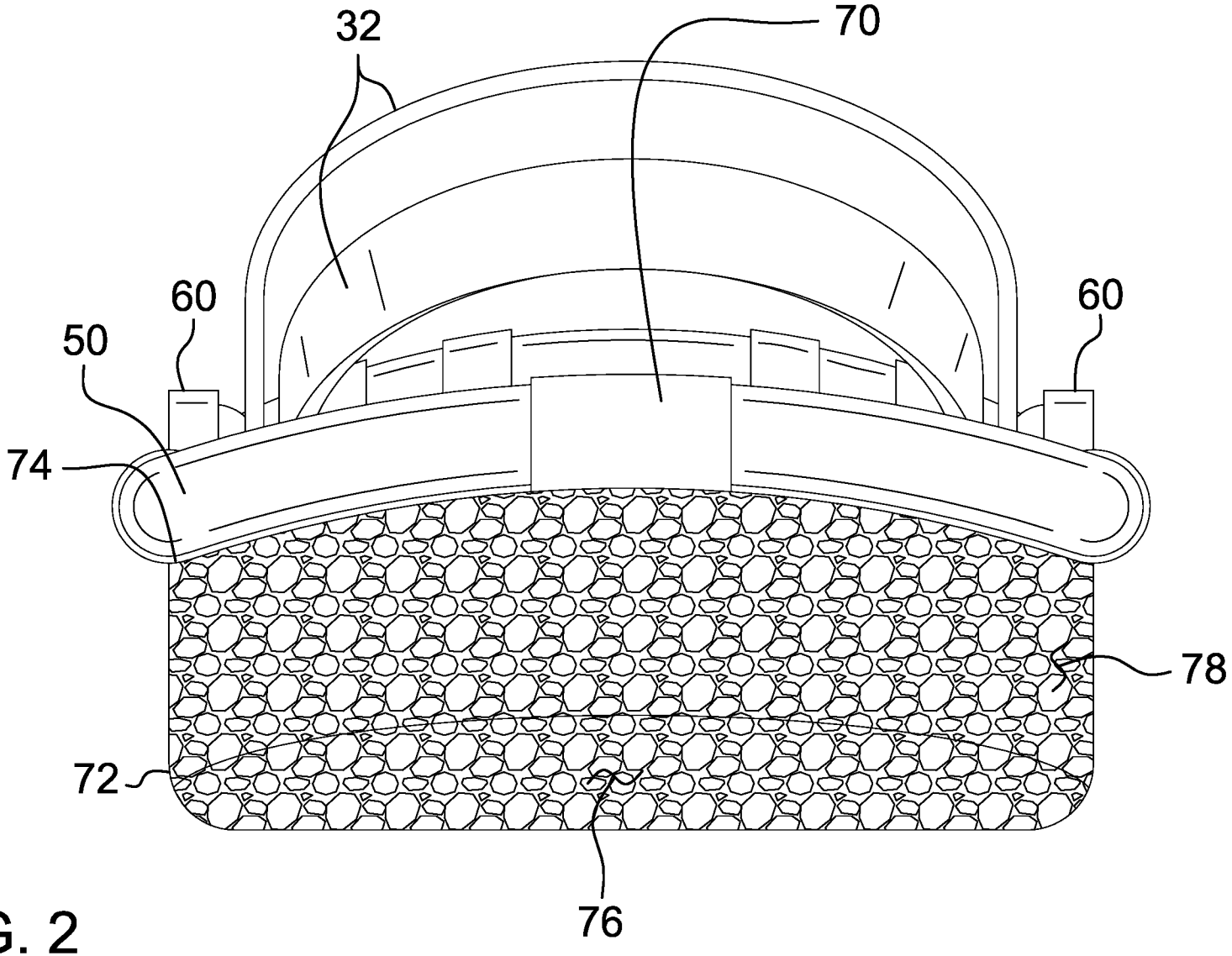
FIG. 2 is a back view of an embodiment of the disclosure.
Figure 3:
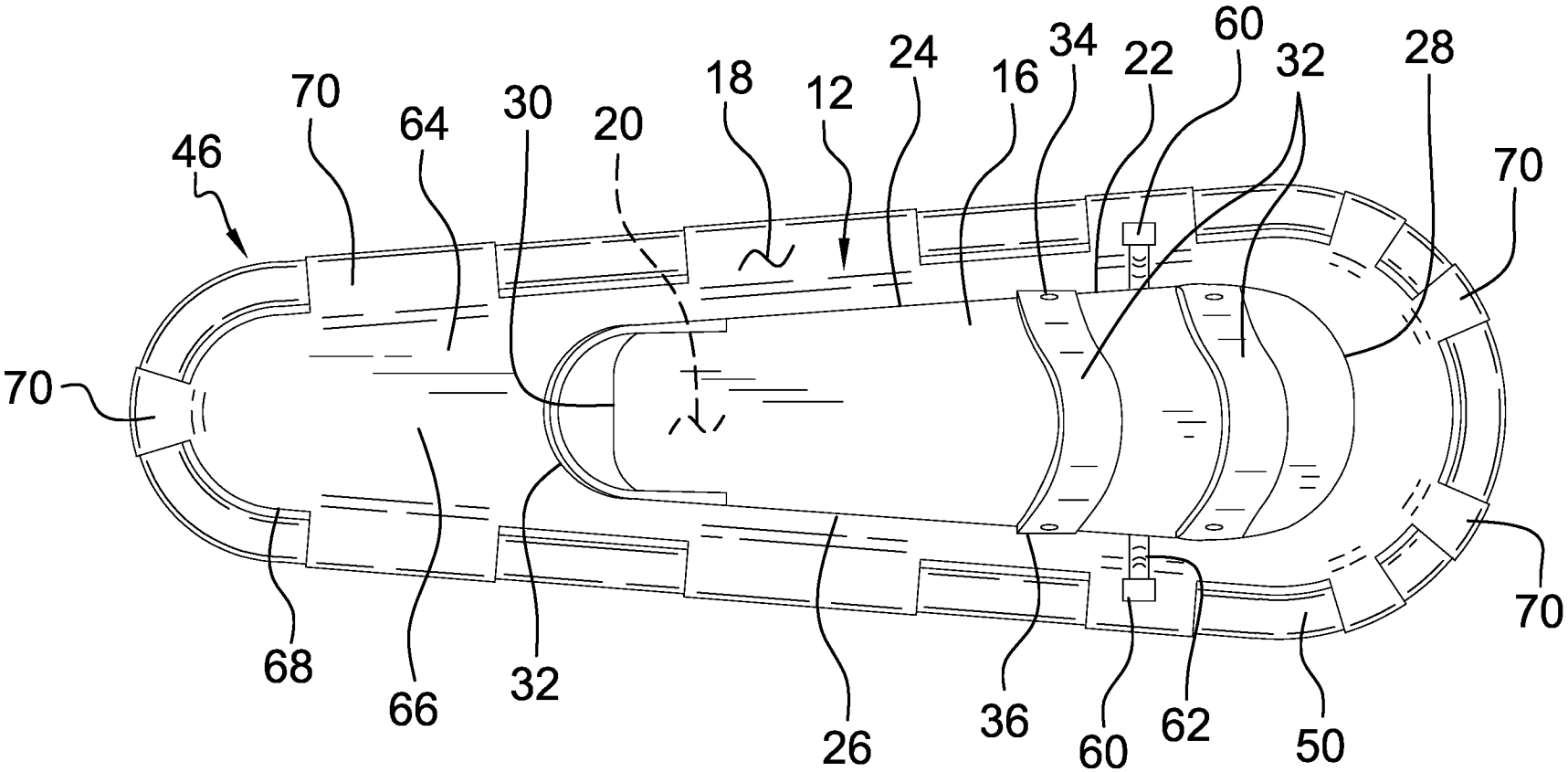
FIG. 3 is a top view of an embodiment of the disclosure.
Figure 4:
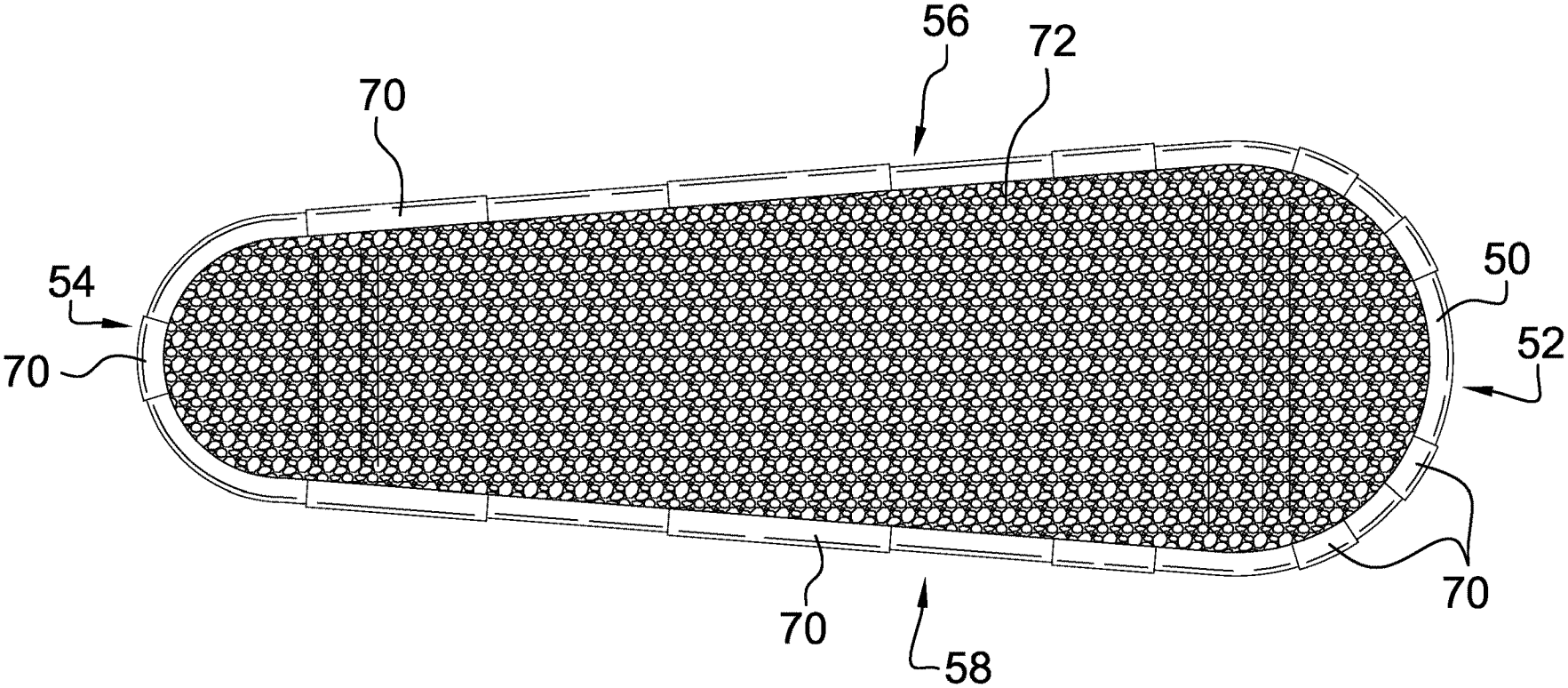
FIG. 4 is a bottom view of an embodiment of the disclosure.
Figure 5:
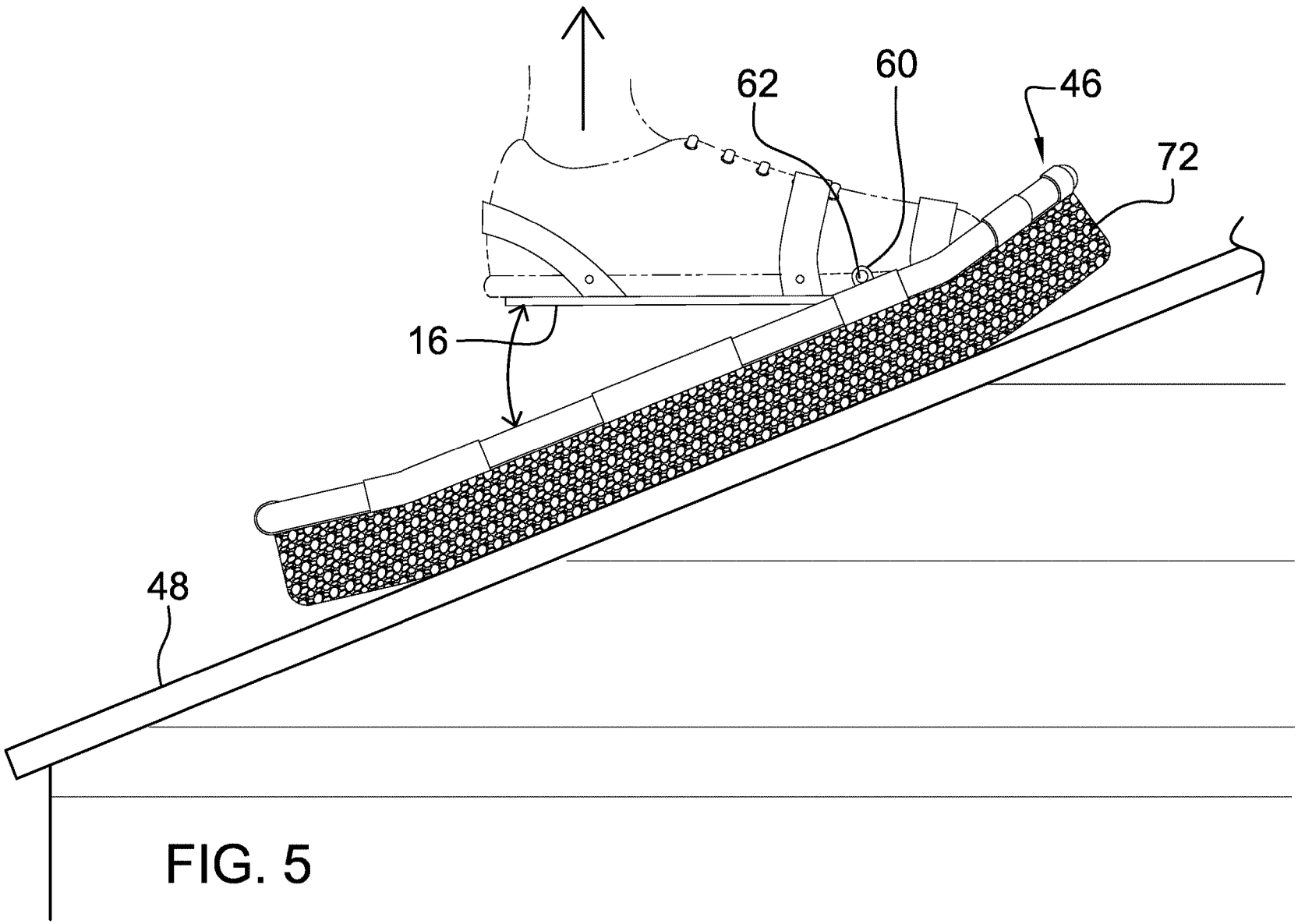
FIG. 5 is a perspective in-use view of an embodiment of the disclosure.

With reference now to the drawings, and in particular to FIGS. 1 through 5 thereof, a new overshoe device embodying the principles and concepts of an embodiment of the disclosure and generally designated by the reference numeral 10 will be described.

As best illustrated in FIGS. 1 through 5, the padded overshoe assembly 10 generally comprises a shoe binding 12 having a user's shoe 14 being positioned in the shoe binding 12. The shoe binding 12 comprises a sole 16 that has a top surface 18, a bottom surface 20 and a perimeter edge 22 extending between the top surface 18 and the bottom surface 20. The perimeter edge 22 has a first lateral side 24, a second lateral side 26, a front side 28 and a back side 30, and the sole 16 is elongated between the front side 28 and the back side 30. The user's shoe 14 might be a work boot, a tennis shoe or any other type of shoe that the user would wear while working.

A plurality of straps 32 is provided and each of the straps 32 has a first end 34 and a second end 36. The first end 34 and the second end 36 of each of the straps 32 is coupled to a respective first lateral side 24 and second lateral side 26 of the perimeter edge 22 of the sole 16 has each of the straps 32 arcing over the top surface 18 of the sole 16. In this way each of the straps 32 can extend over the user's shoe 14 for retaining the sole 16 on the user's shoe 14. The straps 32 are spaced apart from each other and are distributed between the front side 28 and the back side 30 of the perimeter edge 22. The plurality of straps 32 includes a heel strap 38 that is positioned adjacent to the back side 30 of the perimeter edge 22 to extending around a heel 40 of the user's shoe 14. The plurality of straps 32 includes a pair of toe straps 42 each positioned closer to the front side 28 than the back side 30 of the perimeter edge 22 to extend over a toe 44 of the user's shoe 14.

A paddle 46 is provided and the shoe binding 12 is pivotally disposed on the paddle 46. The paddle 46 has a width and a length that is greater than the width and the length of the sole 16. In this way the paddle 46 evenly distributes the user's weight over a surface 48 upon which the user is walking thereby reducing the likelihood the user will damage the surface 48. The surface 48 might be a tile roof or other type of fragile surface that would likely be damaged by the weight of the user walking on the surface 48. The paddle 46 comprises a tube 50 that is continuous such that the tube 50 forms a closed loop. The tube 50 may be elongated to form an ovoid with a front end 52 and a back end 54. Additionally, the front end 52 of the ovoid may have a radius that is greater than the radius of the back end 54 of the ovoid. As is most clearly shown in FIG. 2, the tube 50 may be concavely arcuate between a first lateral side 56 and a second lateral side 58 of the ovoid. As is most clearly shown in FIGS. 1 and 5, the tube 50 may curve upwardly adjacent to each of the front end 52 and the back end 54 of the ovoid.

The paddle 46 includes a pair of receivers 60 that is each coupled to and extends upwardly from the tube 50. The receivers 60 are positioned on opposite sides of the closed loop with respect to each other. The paddle 46 includes a pin 62 that extends laterally through each of the first lateral side 24 and the second lateral side 26 of the perimeter edge 22 of the sole 16. The pin 62 rotatably engages each of the receivers 60 such that the sole 16 is pivotally attached to the tube 50. Moreover, the pin 62 extends through the sole 16 at a location that is positioned closer to the front side 28 than the back side 30 of the perimeter edge 22 of the sole 16. In this way the sole 16 to facilitate the user's heel 40 to travel upwardly and downwardly when the user walks.

The paddle 46 includes a membrane 64 that has a top side 66 and an outer edge 68, and the membrane 64 has a plurality of tabs 70 each extending away from the outer edge 68. The tabs 70 are spaced apart from each other and are distributed around the outer edge 68. Each of the tabs 70 is wrapped around the tube 50 such that the membrane 64 covers the closed loop defined by the tube 50 having the sole 16 being positioned on the top side 66 of the membrane 64. The membrane 64 is comprised of a resiliently stretchable material to facilitate the sole 16 to stretch the membrane 64 downwardly when the user walks. In this way the membrane 64 enhances comfort for the user.

A cushion 72 is provided and the cushion 72 is coupled to and extends downwardly from the paddle 46. In this way the cushion 72 abuts the surface 48 upon which the user is walking. Additionally, the cushion 72 is comprised of a resiliently compressible material to inhibit the surface 48 from being damaged by the user. The cushion 72 has an upper surface 74, a lower surface 76 and an outside surface 78 extending between the upper surface 74 and the lower surface 76. The upper surface 74 is bonded to the tube 50 having the outside surface 78 following contours of the tube 50. The lower surface 76 of the cushion 72 abuts the surface 48 upon which the user is walking.

In use, the user insert's their shoe 14 into each of the straps 32 on the sole 16 for attaching their shoe 14 to the shoe binding 12. In this way the user can walk on the paddle 46 for evenly distributing the user's weight over the surface 48 upon which the user is walking. Additionally, the cushion 72 reduces the impact the user makes on the surface 48 when the user is walking. In this way the user can walk on a surface 48 that might otherwise be damaged by the weight of the user. Additionally, the sole 16 can pivot on the paddle 46 to facilitate the user to walk on a pitched roof, for example, or other sloped surface without having to bend their ankle at a severe angle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A padded overshoe assembly being wearable over shoes for facilitating a user to walk on a fragile surface, said assembly comprising:

a shoe binding having a user's shoe being positioned in said shoe binding;

a paddle having said shoe binding being pivotally disposed thereon;

a cushion being coupled to and extending downwardly from said paddle wherein said cushion is configured to abut the surface upon which the user is walking, said cushion being comprised of a resiliently compressible material wherein said cushion is configured to inhibit the surface from being damaged by the user;

wherein said shoe binding comprises:

a sole having a top surface, a bottom surface and a perimeter edge extending between said top surface and said bottom surface, said perimeter edge having a first lateral side, a second lateral side, a front side and a back side, said sole being elongated between said front side and said back side, and a plurality of straps, each of said straps having a first end and a second end, said first end and said second end of each of said straps being coupled to a respective first lateral side and second lateral side of said perimeter edge of said sole having each of said strap arcing over said top surface of said sole wherein each of said straps is configured to extend over the user's shoe for retaining said sole on the user's shoe, said straps being spaced apart from each other and being distributed between said front side and said back side of said perimeter edge;

said paddle having a width and a length being greater than a width and a length of said sole wherein paddle is configured to evenly distribute the user's weight over a surface upon which the user is walking thereby reducing the likelihood the user will damage the surface; and wherein said paddle comprises a tube being continuous such that said tube forms a closed loop;

a pair of receivers, each of said receivers being coupled to and extending upwardly from said tube, said receivers being positioned on opposite sides of said closed loop with respect to each other; and a pin extending laterally through each of said first lateral side and said second lateral side of said perimeter edge of said sole, said pin rotatably engaging each of said receivers such that said sole is pivotally attached to said tube, said pin extending through said sole at a location being positioned closer to said front side than said back side of said perimeter edge of said sole wherein said sole is configured to facilitate the user's heel to travel upwardly and downwardly when the user walks.

2. The assembly according to claim 1, wherein said paddle includes a membrane having a top side and an outer edge, said membrane having a plurality of tabs each extending away from said outer edge, said tabs being spaced apart from each other and being distributed around said outer edge, each of said tabs being wrapped around said tube such that said membrane covers said closed loop defined by said tube having said sole being positioned on said top side of said membrane, said membrane being comprised of a resiliently stretchable material thereby facilitate said sole to stretch said membrane downwardly when the user walks wherein said membrane is configured to enhance comfort for the user.

3. A padded overshoe assembly being wearable over shoes for facilitating a user to walk on a fragile surface, said assembly comprising:

a shoe binding having a user's shoe being positioned in said shoe binding;

a paddle having said shoe binding being pivotally disposed thereon;

a cushion being coupled to and extending downwardly from said paddle wherein said cushion is configured to abut the surface upon which the user is walking, said cushion being comprised of a resiliently compressible material wherein said cushion is configured to inhibit the surface from being damaged by the user;

wherein said shoe binding comprises:

a sole having a top surface, a bottom surface and a perimeter edge extending between said top surface and said bottom surface, said perimeter edge having a first lateral side, a second lateral side, a front side and a back side, said sole being elongated between said front side and said back side, and a plurality of straps, each of said straps having a first end and a second end, said first end and said second end of each of said straps being coupled to a respective first lateral side and second lateral side of said perimeter edge of said sole having each of said strap arcing over said top surface of said sole wherein each of said straps is configured to extend over the user's shoe for retaining said sole on the user's shoe, said straps being spaced apart from each other and being distributed between said front side and said back side of said perimeter edge;

said paddle having a width and a length being greater than a width and a length of said sole wherein paddle is configured to evenly distribute the user's weight over a surface upon which the user is walking thereby reducing the likelihood the user will damage the surface;

wherein said paddle includes a tube; and wherein said cushion has an upper surface, a lower surface and an outside surface extending between said upper surface and said lower surface, said upper surface being bonded to said tube having said outside surface following contours of said tube wherein said lower surface is configured to abut the surface upon which the user is walking.

4. A padded overshoe assembly being wearable over shoes for facilitating a user to walk on a fragile surface, said assembly comprising:

a shoe binding having a user's shoe being positioned in said shoe binding, said shoe binding comprising:

a sole having a top surface, a bottom surface and a perimeter edge extending between said top surface and said bottom surface, said perimeter edge having a first lateral side, a second lateral side, a front side and a back side, said sole being elongated between said front side and said back side; and a plurality of straps, each of said straps having a first end and a second end, said first end and said second end of each of said straps being coupled to a respective first lateral side and second lateral side of said perimeter edge of said sole having each of said strap arcing over said top surface of said sole wherein each of said straps is configured to extend over the user's shoe for retaining said sole on the user's shoe, said straps being spaced apart from each other and being distributed between said front side and said back side of said perimeter edge;

a paddle having said shoe binding being pivotally disposed thereon, said paddle having a width and a length being greater than a width and a length of said sole wherein paddle is configured to evenly distribute the user's weight over a surface upon which the user is walking thereby reducing the likelihood the user will damage the surface, said paddle comprising:

a tube being continuous such that said tube forms a closed loop;

a pair of receivers, each of said receivers being coupled to and extending upwardly from said tube, said receivers being positioned on opposite sides of said closed loop with respect to each other;

a pin extending laterally through each of said first lateral side and said second lateral side of said perimeter edge of said sole, said pin rotatably engaging each of said receivers such that said sole is pivotally attached to said tube, said pin extending through said sole at a location being positioned closer to said front side than said back side of said perimeter edge of said sole wherein said sole is configured to facilitate the user's heel to travel upwardly and downwardly when the user walks; and a membrane having a top side and an outer edge, said membrane having a plurality of tabs each extending away from said outer edge, said tabs being spaced apart from each other and being distributed around said outer edge, each of said tabs being wrapped around said tube such that said membrane covers said closed loop defined by said tube having said sole being positioned on said top side of said membrane, said membrane being comprised of a resiliently stretchable material thereby facilitate said sole to stretch said membrane downwardly when the user walks wherein said membrane is configured to enhance comfort for the user; and a cushion being coupled to and extending downwardly from said paddle wherein said cushion is configured to abut the surface upon which the user is walking, said cushion being comprised of a resiliently compressible material wherein said cushion is configured to inhibit the surface from being damaged by the user, said cushion having an upper surface, a lower surface and an outside surface extending between said upper surface and said lower surface, said upper surface being bonded to said tube having said outside surface following contours of said tube wherein said lower surface is configured to abut the surface upon which the user is walking.

* * * * *